US006846795B2

(12) United States Patent
Lant et al.

(10) Patent No.: US 6,846,795 B2
(45) Date of Patent: Jan. 25, 2005

(54) DETERGENT COMPOSITIONS

(75) Inventors: Neil Joseph Lant, Newcastle upon Tyne (GB); Serge Eric Salager, Etienne (BE); Johan Hans Eshuis, Antwerp (BE); Angelina Pena-Romero, Tervuren (BE)

(73) Assignee: The Procter & Gamble Company, Cincinnati, OH (US)

( * ) Notice: Subject to any disclaimer, the term of this patent is extended or adjusted under 35 U.S.C. 154(b) by 246 days.

(21) Appl. No.: 09/999,637

(22) Filed: Oct. 24, 2001

(65) Prior Publication Data

US 2002/0119903 A1 Aug. 29, 2002

(30) Foreign Application Priority Data

Oct. 31, 2000 (EP) ..... 00870252

(51) Int. Cl.[7] ..... C11D 17/00
(52) U.S. Cl. ..... 510/446
(58) Field of Search ..... 510/438, 441, 510/443, 444, 446, 447

(56) References Cited

U.S. PATENT DOCUMENTS

| | | | | |
|---|---|---|---|---|
| 3,360,470 A | | 12/1967 | Wixon | |
| 4,175,050 A | * | 11/1979 | Carduck et al. | 510/146 |
| 5,382,377 A | * | 1/1995 | Raehse et al. | 510/445 |
| 6,051,544 A | * | 4/2000 | Lang et al. | 510/446 |
| 6,147,048 A | * | 11/2000 | Huff et al. | 510/438 |

FOREIGN PATENT DOCUMENTS

| | | |
|---|---|---|
| DE | 198 08 758 | 9/1999 |
| EP | 0 481 547 A1 | 4/1992 |
| EP | 0 896 053 A1 | 2/1999 |
| EP | 1 048 718 A1 | 11/2000 |
| WO | WO 99/10471 | 8/1999 |
| WO | WO 00/04129 | 1/2000 |
| WO | WO 00/06683 | 2/2000 |

* cited by examiner

*Primary Examiner*—John Hardee
(74) *Attorney, Agent, or Firm*—Marianne Dressman; Mark A. Charles; Brahm J. Corstanje

(57) ABSTRACT

The present invention relates to a shaped detergent composition, said composition comprising:

(a) a surfactant; and (b) a plurality of discrete particles comprising benefit agent, said particles having a average particle size of at least 1.2 mm, preferably from 1.5 mm to 10 mm, more preferably from 2.0 mm to 5 mm, even more preferably from 2.3 mm to 4 mm.

The compositions of the present invention can be effectively dosed via the dispensing drawer of standard washing machines without being caught up in the mechanism of the.

9 Claims, No Drawings

DETERGENT COMPOSITIONS

CROSS REFERENCE TO RELATED APPLICATIONS

This application claims priority under 35 U.S.C. §119(a) to European Application Serial No. 00870252.4, filed Oct. 31, 2000.

TECHNICAL FIELD

The present invention relates to detergent compositions. In particular, the present invention relates to shaped, multi-phase, detergent compositions.

BACKGROUND TO THE INVENTION

Shaped detergent compositions, such as tablets are known in the art. These compositions hold several advantages over detergent compositions in particulate form such as ease of dosing, handling, transportation and storage. Consumers particularly like the convenience of dosing a shaped composition via the dispensing drawer.

Tablets are typically formed by compression of the various components. The tablets produced must be sufficiently robust to be able to withstand handling and transportation without sustaining damage. In addition, the tablets must also dissolve quickly so that the detergent components are released into the wash water as soon as possible at the beginning of the wash cycle.

Multi-phase detergent tablets have several advantages over single-phase tablets. Most notably multi-phase tablets allow essentially incompatible ingredients to be formulated in a single dosage unit. For example, it is desirable to formulate a single-dose composition that comprises both surfactant and fabric softener. However, many of the commonly used surfactants will form complexes with the fabric softener materials leading to poor cleaning, poor softening and, possibly, residues on the fabric. Therefore, any composition comprising both materials must either be formulated using a limited number of compatible materials or be designed to sequentially release said ingredients, thereby avoiding the problems of incompatibility. Multi-phase tablets described in the prior art are typically prepared by compressing a first composition in a tablet press to form a substantially planar first layer. A further detergent composition is then delivered to the tablet press on top of the first layer. This second composition is then compressed to form another substantially planar second layer. Thus the first layer is generally subjected to more than one compression as it is also compressed during the compression of the second composition. The Applicant has found that, because the compression force must be sufficient to bind the first and second compositions together, the resultant tablet has a slower rate of dissolution. Other multi-phase tablets exhibiting differential dissolution are prepared such that the second layer is compressed at a lower force than the first layer. However, although the dissolution rate of the second layer is improved, the second layer is soft in comparison to the first layer and is therefore vulnerable to damage caused by handling and transportation.

EP-A-481547 discloses a dishwashing detergent tablet which, it is alleged, can provide sequential release of a dishwashing composition and a rinse aid composition. The tablets of EP-A-481547 have an inner layer which is completely surrounded on all sides by a barrier layer which, in turn, is completely surrounded by an outer layer. WO-A-99/40171 discloses a detergent tablet for fabric washing where there is a fabric conditioning agent present in one zone of the tablet at a greater concentration than in another zone. It is claimed that the conditioning agent may be a softening agent in a zone or region which disintegrates later than another zone or region of the tablet. It is alleged that this delayed disintegration can be achieved through blocking access of water to the zone which is intended to disintegrate later or by adding disintegration enhancing materials to the zone which is intended to disintegrate first. WO-A-00/06683 discloses a tablet composition for use in the washing machine that has at least one particle that is made up of at least one nucleus comprising at least one substance that acts mainly during the rinsing process of the washing machine in addition to a coat that fully surrounds the nucleus and comprises at least one compound whose solubility increases when the concentration of a specific ion in the ambient medium is reduced. WO-A-00/04129 describes multi-phase detergent tablets where there is a first phase that is in the form of a shaped body having at least one mould therein and a second phase in the form of a particulate solid compressed within said mould. In preferred embodiments of the multi-phase tablets of WO-A-00/04129 the second phase (and any subsequent phases) dissolves before the first phase.

However, prior art tablets often do not effectively control of the delivery of the actives. Frequently, the active(s) are expelled from the wash before the rinse cycle along with the wash liquor from the main wash. This means they do not have a chance to release the active(s). In addition, when the actives are released early it can lead to essentially incompatible phases being released at the same time. Also, many of the actives work most effectively when released towards the end of the laundry cycle so they are not degraded or washed away by the wash liquor. Moreover, due to their chemical and physical properties, the prior art tablets often do not disintegrate quickly. This means it can be difficult to dose the tablets via the dispensing drawer and there is a risk of residues remaining on the clothes. Furthermore, when dispensed via the drawer the particle size of the disintegrated composition must be such that it can pass from the drawer, through the pipe and into the drum often through small holes.

It is an object of the present invention to provide a shaped detergent composition that can be formulated to delay the delivery of an active until the appropriate time in the laundry cycle. It is a further object of the present invention to provide a shaped detergent composition that is not only sufficiently robust to withstand handling and transportation, but is also convenient to dose via the dispensing drawer. Other objects and advantages shall become apparent as the description proceeds.

SUMMARY OF THE INVENTION

The present invention relates to a shaped detergent composition, said composition comprising:

(a) a surfactant; and (b) a plurality of discrete particles comprising benefit agent, said particles having a average particle size of at least 1.2 mm, preferably from 1.5 mm to 10 mm, more preferably from 2.0 mm to 5 mm, even more preferably from 2.3 mm to 4 mm.

In a preferred aspect of the present invention the shaped body is a tablet comprises:

(a) a first phase comprising surfactant in the form of a shaped body having at least one mould therein; and (b) a subsequent phase compressed within said mould comprising a plurality of discrete particles comprising benefit agent, said particles having a average particle size of at least 1.2 mm, preferably from 1.5 mm to 10 mm, more preferably from 2.0 mm to 5 mm, even more preferably from 2.3 mm to 4 mm.

The compositions of the present invention can be effectively dosed via the dispensing drawer of standard washing machines without being caught up in the mechanism of the machine. In addition, the plurality of discrete particles comprising benefit agent helps to ensure the agent is more evenly distributed around the wash thus there is a more uniform application of the benefit to the fabrics.

In a highly preferred aspect of the present invention the particles of the subsequent phase comprising benefit agent float in deionized water at 20° C. While not wishing to be bound by theory it is believed that having particles comprising benefit agent float means that the particles are more likely to remain in the wash drum during the wash cycle. For example, many benefit agents perform best when they are added during the rinse cycle. However, during a normal wash cycle the wash liquor is pumped out of the machine at the end of the main wash cycle any particles that do not float are likely to be lost with the water. Also, floating particles reduce the risk of these particles being caught up in the mechanism of the washing machine or in the fabrics thus avoiding mechanical stresses that can cause premature release of the benefit agent. This means that the formulator can more accurately control when the benefit agent is released into the wash liquor. Moreover, having particles that float reduces the risk of residue being left when the composition is dosed via the dispensing drawer.

DETAILED DESCRIPTION OF THE INVENTION

The shaped detergent compositions of the present invention comprise a surfactant; and a plurality of discrete particles comprising benefit agent, said particles having a average particle size of at least 1.2 mm, preferably from 1.5 mm to 10 mm, more preferably from 2.0 mm to 5 mm, even more preferably from 2.3 mm to 4 mm. These elements will be described in more detail below. The detergent compositions herein can be any suitable shape such as hexagonal, square, rectangular, cylindrical, spherical etc. Preferably, the compositions herein are rectangular or square as this facilitates their use in the dispensing drawer.

The shaped detergent compositions herein can be of uniform composition. Alternatively, the detergent compositions herein may comprise one or more regions with the concentration of cationic fabric softener and surfactant differing in different regions. It is preferred, but not necessarily essential, that the detergent compositions herein comprise a first phase and the second, and/or any subsequent phase, are spatially distinct in the form of, for example, two layers. As used herein the term "phase" means a distinct, but not necessary homogenous, fraction of the whole composition.

One preferred type of shaped composition herein is a tablet made from compressed particulate. Tablet compositions are usually prepared by pre-mixing components of a detergent composition and forming the pre-mixed detergent components into a tablet using any suitable equipment, preferably a tablet press. The compression of the components of the detergent composition is such that the tablets produced are sufficiently robust to be able to withstand handling and transportation without sustaining damage. In addition to being robust, tablets must also dissolve sufficiently fast so that the detergent components are released into the wash water as soon as possible at the beginning of the wash cycle. Multi-phase tablets are typically prepared by compressing a first composition in a tablet press to form a first phase. A further detergent composition is then delivered to the tablet press and compressed on top of the first phase. Preferably the principal ingredients are used in particulate form. Any liquid ingredients can be incorporated in a conventional manner into solid particulate ingredients. Preferably the tablets are compressed at a force of less than 10000 N/cm$^2$, more preferably not more than 3000 N/cm$^2$, even more preferably not more than 750 N/cm$^2$. Indeed, the more preferred embodiments of the present invention are compressed with a force of less than 500 N/cm$^2$. Generally, the compositions herein will be compressed with relatively low forces to enable them to disintegrate quickly.

The particulate material used for making the tablet of this invention can be made by any particulation or granulation process. An example of such a process is spray drying (in a co-current or counter current spray drying tower) which typically gives low bulk densities of 600 g/l or lower. Particulate materials of higher bulk density can be prepared by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallization centering, etc.

Another preferred form of shaped compositions herein is a pouch. As used herein the term "pouch" means a closed structure, made of a water-soluble film, comprising the surfactant and beads. The pouch can be of any form, shape and material which is suitable to hold the composition, e.g. without allowing substantial release of the composition from the pouch prior to contact of the pouch to water. The exact execution will depend on, for example, the type and amount of the composition in the pouch, the number of compartments in the pouch, the characteristics required from the pouch to hold, protect and deliver or release the compositions. Preferably, the pouch as a whole is stretched during formation and/or closing of the pouch, such that the resulting pouch is at least partially stretched. This is to reduce the amount of film required to enclose the volume space of the pouch. Another advantage of using stretching the pouch, is that the stretching action, when forming the shape of the pouch and/or when closing the pouch, stretches the pouch non-uniformly, which results in a pouch which has a non-uniform thickness. This allows control of the dissolution of water-soluble pouches herein, and for example sequential release of the components of the detergent composition enclosed by the pouch to the water.

The pouch is made from a water-soluble film. Preferred water-soluble films are polymeric materials, preferably polymers which are formed into a film or sheet. The material in the form of a film can for example be obtained by casting, blow-molding, extrusion or blow extrusion of the polymer material, as known in the art.

Preferred polymeric material include polymers, copolymers, or derivatives thereof selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatin, natural gums such as xanthum and carragum. More preferably polyvinyl alcohols, polyvinyl alcohol copolymers, and hydroxypropyl methyl cellulose (HPMC). Preferably, the level of a type polymer (e.g., commercial mixture) in the film material, for example PVA polymer, is at least 60% by weight of the film.

The polymer can have any weight average molecular weight, preferably from about 1000 to 1,000,000, or even form 10,000 to 300,000 or even form 15,000 to 200,000 or even form 20,000 to 150,000.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-dispersible, or water-soluble.

It may be preferred that the polymer present in the film is from 60–98% hydrolyzed, preferably 80% to 90%, to improve the dissolution of the material.

Most preferred are films which are water-soluble and stretchable films, as described above. Highly preferred water-soluble films are films which comprise PVA polymers and that have similar properties to the film known under the trade reference M8630, as sold by Chris-Craft Industrial Products of Gary, Ind., US and also PT-75, as sold by Aicello of Japan.

The water-soluble film herein may comprise other additive ingredients than the polymer or polymer material. For example, it may be beneficial to add plasticizers, for example glycerol, ethylene glycol, diethyleneglycol, propylene glycol, sorbitol and mixtures thereof, additional water, disintegrating aids. It may be useful that the pouch or water-soluble film itself comprises a detergent additive to be delivered to the wash water, for example organic polymeric soil release agents, dispersants, dye transfer inhibitors.

The pouch is made by a process comprising the steps of contacting a composition herein to a water-soluble film in such a way as to partially enclose said composition to obtain a partially formed pouch, optionally contacting said partially formed pouch with a second water-soluble film, and then sealing said partially formed pouch to obtain a pouch.

Preferably, the pouch is made using a mold, preferably the mould has round inner side walls and a round inner bottom wall. A water soluble film may be vacuum pulled into the mould so that said film is flush with the inner walls of the mould. A composition herein may then be poured into the mould, a second water-soluble film may be placed over the mould with the composition and the pouch may then be sealed, preferably the partially formed pouch is heat sealed. The film is preferably stretched during the formation of the pouch.

If the shaped present composition is in the form of a pouch it can be a single compartment pouch or a multi-compartment pouch. When the pouch has multiple compartments the beads and the surfactant may be located in the same compartment or in separate compartments, preferably they are located in separate compartments. Pouches for use herein can contain detergent compositions in any suitable form as long as the compositions comprise surfactant and beads. In particular, the pouches can comprise powders, liquids, solids, gels, foams, and combinations thereof. Preferably, the pouches comprises powder, liquids, and mixtures thereof. Some preferred pouches according to the present invention include:

- single compartment pouch with powder and beads in 2 distinct layers,
- single compartment pouch with powder and beads mixed together,
- single compartment pouch with liquid and beads mixed together,
- dual compartment pouch with powder and beads in separate compartments,
- dual compartment pouch with liquid and beads in separate compartments,
- dual compartment pouch with liquid in one compartment and powder plus beads in the other,
- dual compartment pouch with liquid plus beads in one compartment and powder in the other,
- dual compartment pouch with liquid plus beads in one compartment and powder plus beads in the other.

The compositions herein can also be shaped bodies as described in WO-A-99/27064. That is, detergent tablets comprising a non-compressed, gelatinous body.

Surfactant

An essential feature of the compositions of the present invention is that they comprise surfactant. Any suitable surfactant may be used. Preferred surfactants are selected from anionic, amphoteric, zwitterionic, nonionic (including semi-polar nonionic surfactants), cationic surfactants and mixtures thereof.

The compositions preferably have a total surfactant level of from 0.5% to 75% by weight, more preferably from 1% to 50% by weight, most preferably from 5% to 30% by weight of total composition.

Preferably the particles comprising surfactant in the present compositions are at least about 90% dissolved in the wash liquor, at the latest, within ten minutes of the start of the main wash cycle of the washing machine. This allows the agents for use in the main wash cycle to enter the wash liquor quickly. It is preferred that the surfactant reaches its peak concentration in the wash liquor within the first ten minutes, preferably within the first five minutes, more preferably within the first two minutes of the main wash cycle of a washing machine.

Detergent surfactants are well-known and fully described in the art (see, for example, "Surface Active Agents and Detergents", Vol. I & II by Schwartz, Perry and Beach). Some non-limiting examples of suitable surfactants for use herein are:

Nonionic Surfactants

Essentially any nonionic surfactants useful for detersive purposes can be included in the present detergent compositions. Preferred, non-limiting classes of useful nonionic surfactants include nonionic ethoxylated alcohol surfactant, end-capped alkyl alkoxylate surfactant, ether-capped poly (oxyalkylated) alcohols, nonionic ethoxylated/propoxylated fatty alcohol surfactant, nonionic EO/PO condensates with propylene glycol, nonionic EO condensation products with propylene oxide/ethylene diamine adducts.

In a preferred embodiment of the present invention the detergent tablet comprises a mixed nonionic surfactant system comprising at least one low cloud point nonionic surfactant and at least one high cloud point nonionic surfactant.

"Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer's Encyclopedia of Chemical Technology, 3rd Ed. Vol. 22, pp. 360–379).

As used herein, a "low cloud point" nonionic surfactant is defined as a nonionic surfactant system ingredient having a cloud point of less than 30° C., preferably less than 20° C., and most preferably less than 10° C.

Low cloud point nonionic surfactants additionally comprise a polyoxyethylene, polyoxypropylene block polymeric compound. Block polyoxyethylene-polyoxypropylene polymeric compounds include those based on ethylene glycol, propylene glycol, glycerol, trimethylolpropane and ethylenediamine as initiator reactive hydrogen compound. Certain of the block polymer surfactant compounds designated PLURONIC™, REVERSED PLURONIC™, and TETRONIC™ by the BASF-Wyandotte Corp., Wyandotte, Mich., are suitable in ADD compositions of the invention. Preferred examples include REVERSED PLURONIC™ 25R2 and TETRONIC™ 702, Such surfactants are typically useful herein as low cloud point nonionic surfactants.

As used herein, a "high cloud point" nonionic surfactant is defined as a nonionic surfactant system ingredient having a cloud point of greater than 40° C., preferably greater than 50° C., and more preferably greater than 60° C.

Anionic Surfactants

Essentially any anionic surfactants useful for detersive purposes are suitable for use herein. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Secondary alkyl sulphate surfactants are also suitable for use herein. These include those disclosed in U.S. Pat. No. 6,015,784. Preferred secondary alkyl sulphate surfactants are those materials which have the sulphate moiety distributed randomly along the hydrocarbyl "backbone" of the molecule. Such materials may be depicted by the structure:

$$CH_3(CH_2)_n(CHOSO_3^-M^+)(CH_2)_mCH_3$$

wherein m and n are integers of 2 or greater and the sum of m+n is typically form 9 to 17, and M is a water-solublising cation. Preferred secondary alkyl surfactants for use herein have the formula:

$$CH_3(CH_2)_x(CHOSO_3^-M^+)CH_3, \text{ and}$$

$$CH_3(CH_2)_y(CHOSO_3^-M^+)CH_2CH_3$$

wherein x and (y+1) are intergers of at least 6, and preferably range from 7 to 20, more preferably from 10 to 16. M is a cation, such as alkali metal, ammonium, alkanolammonium, alkaline earth metal or the like. Sodium is typically used. Secondary alkyl surfactants suitable for use herein are described in more detail in U.S. Pat. No. 6,015,784.

Amphoteric Surfactants

Suitable amphoteric surfactants for use herein include the amine oxide surfactants and the alkyl amphocarboxylic acids.

Zwitterionic Surfactants

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R^1)_2N^+R^2COO^-$ wherein R is a $C_6$–$C_{18}$ hydrocarbyl group, each $R_1$ is typically $C_1$–$C_3$ alkyl, and $R^2$ is a $C_1$–$C_5$ hydrocarbyl group. Preferred betaines are $C_{12}$–$C_{18}$ dimethyl-ammonio hexanoate and the $C_{10}$–$C_{18}$ acylamidopropane (or ethane) dimethyl (or diethyl) betaines. Complex betaine surfactants are also suitable for use herein.

Cationic Surfactants

Cationic ester surfactants used in this invention are preferably water dispersible compound having surfactant properties comprising at least one ester (i.e. —COO—) linkage and at least one cationically charged group. Other suitable cationic ester surfactants, including choline ester surfactants, have for example been disclosed in U.S. Pat. Nos. 4,228,042, 4,239,660 and U.S. Pat. No. 4,260,529.

Suitable cationic surfactants include the quaternary ammonium surfactants selected from mono $C_6$–$C_{16}$, preferably $C_6$–$C_{10}$N-alkyl or alkenyl ammonium surfactants wherein the remaining N positions are substituted by methyl, hydroxyethyl or hydroxypropyl groups.

Preferred surfactants for use herein are selected from anionic sulphonate surfactants (particularly linear alkylbenzene sulphonates), anionic sulphate surfactants (particularly $C_{12}$–$C_{18}$ alkyl sulphates), secondary alkyl sulphate surfactants, nonionic surfactants and mixtures thereof.

Benefit Agent

Another essential feature of the compositions of the present invention is that they comprise a plurality of particles comprising benefit agent. The particles comprising benefit agent can be in the form of granules, beads, noodles, pellets, compressed tablets, filled sachets, and mixtures thereof. Preferably the particles are in the form of beads. It is preferred that the particles of the subsequent phase that comprise the benefit agent are substantially spherical in shape.

The particle in the subsequent phase comprising the benefit agent preferably float in deionised water at 20° C. In general, particles that are less dense than water will float.

As used herein the term "benefit agent" means a compound or mixture of compounds that provides the present compositions with a property that consumers find desirable. The subsequent phase of the present compositions can comprise more than one benefit agent where each agent provides a different benefit.

Preferably the benefit agent for use herein is selected from cationic softening agents, perfumes, suds-suppressing system, wrinkle reducing agents, chelating agents, dye fixing agents, fabric abrasion reducing polymers, and mixture thereof. More preferably the benefit agent for use herein is selected from cationic softening agents, perfumes, suds-suppressing system and mixtures thereof. Even more preferably the benefit agent for use herein is selected from cationic softening agents, perfumes and mixtures thereof The particle in the subsequent phase comprising the benefit agent preferably float in deionised water at 20° C. In general, particles that are less dense than water will float. Another, preferred, method of ensuring that the particles float is by use of an effervescent system. As used herein, effervescency means the evolution of bubbles of gas from a liquid, as the result of a chemical reaction. This reaction can be between, for example, a soluble acid source and an alkali metal carbonate, to produce carbon dioxide gas. The use of an effervescency allows the formulator greater flexibility since it means the particles can be more dense that the wash liquor and still survive. In addition, the effervescency can provide other benefits in shaped compositions such as aiding disintegration.

Any suitable effervescent system may be used herein. Preferably the effervescency is produced using an acid source, capable of reacting with an alkali source in the presence of water to produce a gas.

The acid source component may be any organic, mineral or inorganic acid, or mixtures thereof. Preferably the acid source is an organic acid. The acid component is preferably substantially anhydrous or non-hygroscopic and the acid is preferably water-soluble. Suitable acid sources include citric acid, maleic acid, maleic acid, fumaric acid, aspartic acid, glutaric acid, tartaric acid, succinic acid, adipic acid, monosodium phosphate, boric acid, and mixture thereof. Preferred are citric acid, maleic acid, maleic acid, and mixtures, especially citric acid.

As discussed above the effervescent system preferably comprises an alkali source. It should be understood that the alkali source may be comprised in the particle or in the rest of the composition or may be present in the wash liquor whereto the bead is added. However, in the present invention it is usually necessary to formulate the alkali source in the bead since this allows the effervescency to be more precisely controlled by the formulator. Any suitable alkali source which has the capacity to react with the acid source and produce a gas may be used herein. The alkali source is preferably a source of carbonate such as an alkali metal carbonate. Preferred for use herein are sodium carbonate, potassium carbonate, bicarbonate, sesqui-carbonate, and mixtures thereof.

The molecular ratio of the acid source to the alkali source in the beads herein is preferably from 20:1 to 1:20, more preferably from 10:1 to 1:10, even more preferably from 5:1 to 1:5, even more preferably still from 2:1 to 1:2.

The ability of the particles to resist dissolution can be measure using the 'Sieve Test' method. The method uses the apparatus as described in the United States Pharmacopoeia (USP) 711 Dissolution test. The particles are weighed and then introduced into a glass vessel as described in the 'Apparatus 1' section (page 1942, USP 24) filled with 1 liter of de ionized water at 20° C. As soon as the particles are introduced, the paddle stirring element described in the 'Apparatus 2' section of the USP 711 Dissolution test is activated at a speed of 100 rotations per minute for the required test time. The preferred distance between the bottom of the vessel and the paddle is 25 mm but can be adapted if necessary. The preferred vessel volume capacity should be 1 liter but a vessel of 2 liter capacity can also be used if necessary. A common apparatus used to perform this test is the Sotax® AT7.

At the end of the required test time, in this case 5, 10 or 15 minutes, the mechanical agitation is stopped and the stirring element is removed from the vessel. In order to recuperate the particles that didn't dissolve, the solution and all the undissolved particles are poured through a sieve that will retain the required particle size: in this case, a mesh size of 0.5×.0.5 mm should be used.

In order to calculate the dry percentage of remaining undissolved particles in solution, the particles that were retained in the required mesh size sieve are dried at 35° C. for at least 12 hours. After this drying step, the particles are weighted and the percentage calculated.

Preferably the particles comprising benefit agent remain at least 75% undissolved for at least 5 minutes, preferably at least 10 minutes, more preferably at least 20 minutes after the start of the main wash cycle of the washing machine. It is highly preferred that the particles comprising benefit agents remain at least 50%, more preferably at least 75%, undissolved until the start of the rinse cycle of the washing machine. It is preferred that the benefit agent is completely dissolved by the end of the wash.

The particles herein preferably float in deionised water at 20° C. for at least 5 minutes, more preferably at least 10 minutes, more preferably at least 15 minutes.

Cationic Softening Agents

Cationic softening agents are one of the preferred benefit agents for use in the subsequent phase. Any suitable cationic softening agents may be used herein but preferred are quaternary ammonium agents. As used herein the term "quaternary ammonium agent" means a compound or mixture of compounds having a quaternary nitrogen atom and having one or more, preferably two, moieties containing six or more carbon atoms. Preferably the quaternary ammonium agents for use herein are selected from those having a quaternary nitrogen substituted with two moieties wherein each moiety comprises ten or more, preferably 12 or more, carbon atoms.

Preferably the present compositions comprise from 0.1% to 40%, more preferably from 0.5% to 15%, by weight of total composition, of cationic softening agent. It is highly preferred that any cationic softening agent be concentrated in the second and/or subsequent phases. Therefore, when present, preferably at least 60%, more preferably at least 80%, even more preferably at least 95% of the total quaternary ammonium compound is concentrated in the second and/or subsequent phases.

Preferred cationic softening agents for use herein are selected from:

(a) quaternary ammonium compounds according to general formula (I):

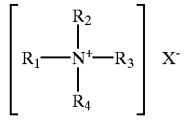

(I)

wherein, $R_1$ & $R_2$ are each $C_1$–$C_4$ alkyl or $C_1$–$C_4$ hydroxyalkyl groups or hydrogen. $R_3$ & $R_4$ are each alkyl or alkenyl groups having from about 8 to about 22 carbon atoms. $X^-$ is a salt forming anion, compatible with quaternary ammonium compounds and other adjunct ingredients.

Preferred quaternary ammonium compounds of this type are quaternised amines having the general formula (I) where $R_1$ & $R_2$ are methyl or hydroxyethyl and $R_3$ & $R_4$ are linear or branched alkyl or alkenyl chains comprising at least 11 atoms, preferably at least 15 carbon atoms.

(b) quaternary ammonium compounds according to general formula (II) or (III):

(II)

$$\left[(R_5)_{4-m}-N^+-\left(\left(CH_2\right)_n-Q-R_6\right)_m\right]X^-$$

(III)

$$\left[(R_5)_{4-m}-N^+-\left(\left(CH_2\right)_n-\underset{\underset{Q-R_6}{|}}{CH}-CH_2-Q-R_6\right)_m\right]X^-$$

wherein, each $R_5$ unit is independently selected from hydrogen, branched or straight chain $C_1$–$C_6$ alkyl, branched or straight chain $C_1$–$C_6$ hydroxyalkyl and mixtures thereof, preferably methyl and hydroxyethyl; each $R_6$ unit is independently linear or branched $C_{11}$–$C_{22}$ alkyl, linear or branched $C_{11}$–$C_{22}$ alkenyl, and mixtures thereof; $X^-$ is an anion which is compatible with skin care actives and adjunct ingredients; m is from 1 to 4, preferably 2; n is from 1 to 4, preferably 2 and Q is a carbonyl unit selected from:

$$-O-\overset{\overset{O}{\|}}{C}-,\quad -\overset{\overset{O}{\|}}{C}-O-,\quad -O-\overset{\overset{O}{\|}}{C}-O-,$$

$$-\overset{\overset{R_7}{|}}{N}-\overset{\overset{O}{\|}}{C}-,\quad -\overset{\overset{O}{\|}}{C}-\overset{\overset{R_7}{|}}{N}-,\ \text{and}\quad -\overset{\overset{R_7}{|}}{HC}-O-\overset{\overset{O}{\|}}{C}-$$

wherein $R_7$ is hydrogen, $C_1$–$C_4$ alkyl, $C_1$–$C_4$ hydroxyalkyl, and mixtures thereof.

In the above quaternary ammonium compound example, the unit —$QR_6$ contains a fatty acyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, rapeseed oil, sunflower oil, corn oil, soybean oil, tall oil, rice bran oil, etc. and mixtures of these oils.

The preferred quaternary ammonium compounds of the present invention are the diester and/or diamide Quaternary Ammonium (DEQA) compounds, the diesters and diamides having general formula (II), wherein the carbonyl group Q is selected from:

$$-O-\overset{\overset{O}{\|}}{C}-,\quad -\overset{\overset{O}{\|}}{C}-O-,\ \text{and}\quad -\overset{\overset{R_7}{|}}{N}-\overset{\overset{O}{\|}}{C}-$$

Tallow, canola and palm oil are convenient and inexpensive sources of fatty acyl units which are suitable for use in the present invention as $R_6$ units.

As used herein, when the diester is specified, it will include the monoester and triester that are normally present as a result of the manufacture process.

(c) quaternary ammonium compounds according to general formula (IV) or (V):

(IV)

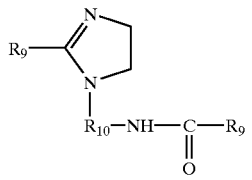

(V)

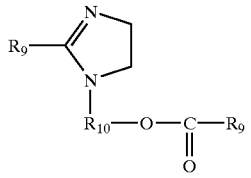

wherein $R_9$ is an acyclic aliphatic $C_{15}$–$C_{21}$ hydrocarbon group and $R_{10}$ is a $C_1$–$C_6$ alkyl or alkylene group.

These ammonium compounds, having a pKa value of not greater than about 4, are able to generate a cationic charge in situ when dispersed in an aqueous solution, providing that the pH of the final composition is not greater than about 6.

(d) quaternary ammonium compounds according to general formula (VI) or (VII):

(VI)

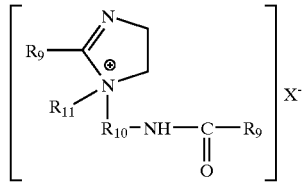

(VII)

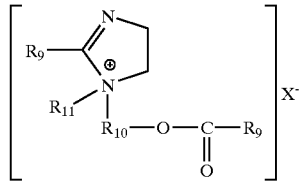

wherein $R_9$ & $R_{10}$ are as specified hereinabove and $R_{11}$ is selected from $C_1$–$C_4$ alkyl and hydroxyalkyl groups.

(e) quaternary ammonium compounds according to general formula (VIII) or (IX):

(VIII)

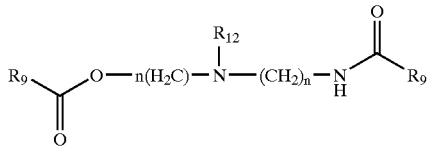

(IX)

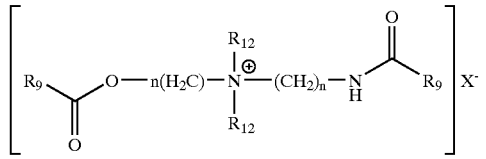

wherein, n is from 1 to 6, $R_9$ is selected from acyclic aliphatic $C_{15}$–$C_{21}$ hydrocarbon groups and $R_{12}$ is selected from $C_1$–$C_4$ alkyl and hydroxyalkyl groups.

These ammonium compounds (VIII), having a pKa value of not greater than about 4, are able to generate a cationic charge in situ when dispersed in an aqueous solution, providing that the pH of the final composition is not greater than about 6.

(f) diquaternary ammonium compounds according to general formula (X), (XI), (XII) or (XIII):

(X)

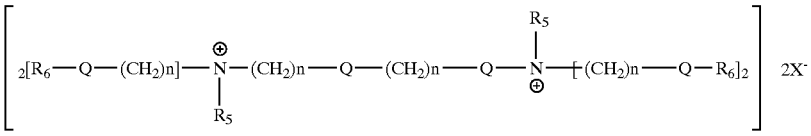

(XI)

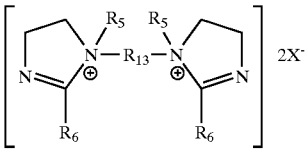

(XII)

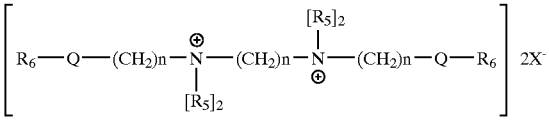

(XIII)

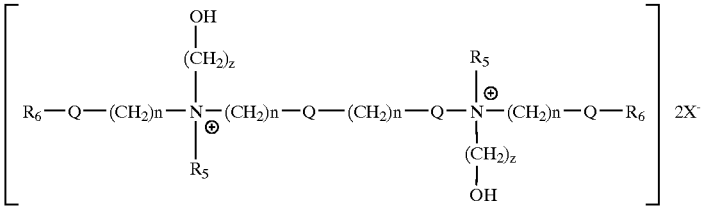

wherein $R_5$, $R_6$, Q, n & $X^-$ are as defined hereinabove in relation to general formula (II) and (III), $R_{13}$ is selected from $C_1$–$C_6$ alkylene groups, preferably an ethylene group and z is from 0 to 4.

(g) mixtures of the above quaternary ammonium compounds.

The counterion, $X^-$ in the above compounds, can be any compatible anion.

The preferred quaternary ammonium agents for use in the present invention are those described in section (b) hereinabove. In particular, diester and/or diamide quaternary ammonium (DEQA) compounds according to general formula (II) hereinabove are preferred. Preferred diesters for use herein are those according to general formula (II) wherein $R_5$, $R_6$, and $X^-$ are as defined hereinabove and Q is:

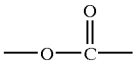

Preferred diamides for use herein are those according to general formula (II) wherein $R_5$, $R_6$, and $X^-$ are as defined hereinabove and Q is:

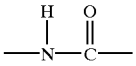

Preferred examples of quaternary ammonium compounds suitable for use in the compositions of the present invention are N,N-di(canolyl-oxy-ethyl)-N,N-dimethyl ammonium chloride, N,N-di(canolyl-oxy-ethyl)-N-methyl,N-(2-hydroxyethyl) ammonium methyl sulfate, N,N-di(canolyl-oxy-ethyl)-N-methyl, N-(2-hydroxyethyl) ammonium chloride and mixtures thereof. Particularly preferred for use herein is N,N-di(canolyl-oxy-ethyl)-N-methyl,N-(2-hydroxyethyl) ammonium methyl sulfate.

Although quaternary ammonium compounds are derived from "canolyl" fatty acyl groups are preferred, other suitable examples of quaternary ammonium compounds are derived from fatty acyl groups wherein the term "canolyl" in the above examples is replaced by the terms "tallowyl, cocoyl, palmyl, lauryl, oleyl, ricinoleyl, stearyl, palmityl" which correspond to the triglyceride source from which the fatty acyl units are derived. These alternative fatty acyl sources can comprise either fully saturated, or preferably at least partly unsaturated chains.

Perfume

A highly preferred benefit agent for use herein is perfume. It is very desirable to the consumer that the fabrics smell pleasant after washing. However, perfume materials are expensive and, in prior art compositions, are often lost in the wash. Therefore, it is advantageous to release perfume in the rinse cycle where it is less likely to be lost.

In the context of this specification, the term "perfume" means any odoriferous material or any material which acts as a malodor counteractant. In general, such materials are characterized by a vapour pressure greater than atmospheric pressure at ambient temperatures. The perfume or deodorant materials employed herein will most often be liquid at ambient temperatures, but also can be solids such as the various tamphoraceous perfumes known in the art. A wide variety of chemicals are known for perfumery uses, including materials such as aldehydes, ketones, esters and the like. More commonly, naturally occurring plant and animal oils and exudates comprising complex mixtures of various chemicals components are known for use as perfumes, and such materials can be used herein. The perfumes herein can be relatively simple in their composition or can comprise highly sophisticated, complex mixtures of natural and synthetic chemical components, all chosen to provide any desired odor.

The perfume component of the present invention may comprise an encapsulate perfume, a properfume, neat perfume materials, and mixtures thereof.

Perfumes which are normally solid can also be employed in the present invention. These may be admixed with a liquefying agent such as a solvent prior to incorporation into the particles, or may be simply melted and incorporated, as long as the perfume would not sublime or decompose upon heating.

The invention also encompasses the use of materials which act as malodor counteractants. These materials, although termed "perfumes" hereinafter, may not themselves have a discernible odor but can conceal or reduce any unpleasant doors. Examples of suitable malodor counteractants are disclosed in U.S. Pat. No. 3,102,101, issued Aug. 27, 1963, to Hawley et al.

By encapsulated perfumes it is meant perfumes that are encapsulated within a capsule comprising an encapsulating material or a perfume which is loaded onto a, preferably porous, carrier material which is then preferably encapsulated within a capsule comprising an encapsulating material.

A wide variety of capsules exist which will allow for delivery of perfume effect at various times during the use of the detergent compositions.

Examples of such capsules with different encapsulated materials are capsules provided by microencapsulation. Here the perfume comprises a capsule core which is coated completely with a material which may be polymeric. U.S. Pat. No. 4,145,184, Brain et al, issued Mar. 20, 1979, and U.S. Pat. No. 4,234,627, Schilling, issued Nov. 18, 1980, teach using a tough coating material which essentially prohibits the diffusions out of the perfume.

The choice of encapsulated material to be used in the perfume particles of the present invention will depend to some degree on the particular perfume to be used and the conditions under which the perfume is to be released. Some perfumes will require a greater amount of protection than others and the encapsulating material to be used therewith can be chosen accordingly.

The encapsulating materials of the perfumed particles is preferably a water-soluble or water-dispersible encapsulating material.

Nonlimiting examples of suitable water-soluble coating materials include such substances as methyl cellulose, maltodextrin and gelatin. Such coatings can comprise from 1% to 25% by weight of the particles.

Especially suitable water-soluble encapsulating materials are capsules which consist of a matrix of polysaccharide and polyhydroxy compounds such as described in GB-A-1,464,616.

Other suitable water soluble or water dispersible encapsulating materials comprise dextrins derived from ungelatinized starch acid-esters of substituted dicarboxylic acids such as described in U.S. Pat. No. 3,455,838. These acid-ester dextrins are, preferably, prepared from such starches as waxy maize, waxy sorghum, sago, tapioca and potato. Suitable examples of said encapsulating materials are N-Lok®, manufactured by National Starch, Narlex® (ST and ST2), and Capsul E®. These encapsulating materials comprise pregelatinised waxy maize starch and, optionally, glucose. The starch is modified by adding monofunctional substituted groups such as octenyl succinic acid anhydride.

For enhanced protection of the perfume particles in a liquid product, it may be more effective to encapsulate the perfume with a material that is pH sensitive, i.e., a material that will remain as a coating on the particle in one pH environment but which would be removed from the particle in a different pH environment. This would allow for further protection of perfume in especially liquid or gel compositions over long storage periods, i.e., the perfume would not diffuse out of the particle in the liquid medium as readily. Diffusion of the perfume out of the stripped particle would then take place after the particles were brought into contact with a different pH environment.

The encapsulated perfume particles can be made by mixing the perfume with the encapsulating matrix by spray-drying emulsions containing the encapsulating material and the perfume. In addition, the particle size of the product from the spray-drying tower can be modified. These modifications can comprise specific processing steps such as post-tower agglomeration steps (e.g. fluidized bed) for enlarging the particle size and/or processing steps wherein the surface properties of the encapsulates are modified, e.g. dusting with hydrophobic silica in order to reduce the hygroscopicity of the encapsulates.

A particularly preferred encapsulation process is an emulsification process followed by spray-drying and finally dusting with silica. The emulsion is formed by:

a) dispersing the starch matrix in water at room temp. in a 1:2 ratio. It is preferred that the starch is pregelatinised so that the emulsion can be carried out at this temperature. This in turn minimizes perfume loss. There must be a "low viscosity" starch to achieve high starch concentrations in water and high perfume loadings.

b) the perfume oil is then added to the above mixture in the ratio of 0.8–1.05:1:2, and the mixture is then emulsified using a high shear mixer. The shearing motion must produce oil droplets below 1 micron and the emulsion must be stable in this form for at least 20 mins (the function of the starch is to stabilize the emulsion once it's mechanically made).

c) the mixture is spray-dried in a co-current tower fitted with a spinning disk atomizer. The drying air inlet temperature is low 150–200° C. This type of spray-drying ensures minimum loss of perfume and high drying rate. The granules have a particulate size of 50–150 microns.

d) the resulting dried encapsulates can contain up to 5% unencapsulated oil at the surface of the granules. To improve the flow characteristics up to 2% hydrophobic silica can be optionally added to the encapsulates via a ribbon blender.

Alternatively the perfume may be loaded onto a carrier and then optionally encapsulated. Suitable carriers are porous and do not react with the perfume. A suitable carrier is zeolite as described in WO-A-94/28107.

The perfume component may alternatively comprise a pro-perfumes. Pro-perfumes are perfume precursors which release the perfume on interaction with an outside stimulus for example, moisture, pH, chemical reaction. Suitable pro-perfumes include those described in U.S. Pat. No. 5,139,687 Borcher et al. Issued Aug. 18, 1992 and U.S. Pat. No 5,234,610 Gardlik et al. Issued Aug. 10, 1993.

Examples of suitable pro-perfumes comprise compounds having an ester of a perfume alcohol. The esters includes at least one free carboxylate group and has the formula

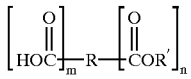

wherein R is selected from the group consisting of substituted or unsubstituted $C_1$–$C_{30}$ straight, branched or cyclic alkyl, alkenyl, alkynyl, alkylaryl or aryl group; R' is a perfume alcohol with a boiling point at 760 mm Hg of less than about 300° C.; and n and m are individually an integer of 1 or greater.

The perfume component may further comprise an ester of a perfume alcohol wherein the ester has at least one free carboxylate group in admixture with a fully eterfied ester of a perfume alcohol.

Preferably, R is selected from the group consisting of substituted or unsubstituted $C_1$–$C_{20}$ straight, branched or cyclic alkyl, alkenyl, alkynyl, alkylaryl, aryl group or ring containing a herteroatom. R' is preferably a perfume alcohol selected from the group consisting of geraniol, nerol, phenoxanol, floralol, β-citronellol, nonadol, cyclohexyl ethanol, phenyl ethanol, phenoxyethanol, isobomeol, fenchol, isocyclogeraniol, 2-phenyl-1-propanol, 3,7-dimethyl-1-octanol, and combinations thereof and the ester is preferably selected from maleate, succinate adipate, phthalate, citrate or pyromellitate esters of the perfume alcohol. The most preferred esters having at least one free carboxylate group are then selected from the group consisting of geranyl succinate, neryl succinate, (b-citronellyl) maleate, nonadol maleate, phenoxanyl maleate, (3,7-dimethyl-1-octanyl) succinate, (cyclohexylethyl) maleate, florally succinate, (b-citronellyl) phthalate and (phenylethyl) adipate.

Pro-perfumes suitable for use herein include include those known in the art. Suitable pro-perfumes can be found in the art including U.S. Pat. No. : 4,145,184, Brain and Cummins, issued Mar. 20, 1979; U.S. Pat. No. 4,209,417, Whyte, issued Jun. 24, 1980; U.S. Pat. No. 4,545,705, Moeddel, issued May 7, 1985; and U.S. Pat. No. 4,152,272, Young, issued May 1, 1979.

It may be desirable to add additional perfume to the composition, as is, without protection via the capsules. Such perfume loading would allow for aesthetically pleasing fragrance of the detergent tablet itself.

The present compositions preferably comprise perfume component at a level of from 0.05% to 15%, preferably from 0.1% to 10%, most preferably from 0.5% to 5% by weight.

Chelants/Heavy Metal Ion Sequestrant

The compositions herein can comprise chelants/heavy metal ion sequestrants as the benefit agent. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof.

Suds Suppressing System

The compositions of the present invention can comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl and alcanol antifoam compounds. Preferred suds suppressing systems and antifoam compounds are disclosed WO-A-93/08876 and EP-A-705 324.

Dye Fixing Agent

The compositions of the present invention can comprise dye fixing agents (fixatives) as the benefit agent. These are well-known, commercially available materials which are designed to improve the appearance of dyed fabrics by minimising the loss of dye from the fabrics due to washing. Many dye fixatives are cationic and are based on quaterinised nitrogen compounds or on nitrogen compounds having a strong cationic charge which is formed in situ under the conditions of usage. Cationic fixatives are available under various trade names from several suppliers. Representative trade names include CROSCOLOR PMF and CROSCOLOR NOFF from Crosfield, INDOSOL E-50 from Sandoz, SANDOFIX TPS from Sandoz, SANDOFIX SWE from Sandoz, REWIN SRF, REWIN SRF-O and REWIN DWE from CHT-Beitlich GmbH, Tinofix ECO, Tinofix FRD and Solfin from Ciba-Geigy.

Other suitable cationic dye fixing agents are described in "Aftertreatments for Improving the Fastness of Dyes on Textile Fibres", Christopher C. Cook, *Rev. Prog. Coloration*, Vol. XII (1982). Dye fixing agents suitable for use in the present compositions include ammonium compounds such as fatty acid-diamine condensates inter alia the hydrochloride, acetate, metosulphate and benzyl hydrochloride salts of diamine esters. Non-limiting examples include oleyldiethyl aminoethylamide, oleylmethyl diethylenediamine methosulphate, monostearylethylene diaminotrimethylammonium methosulphate. In addition, the N-oxides of tertiary amines, derivatives of polymeric alkyldiamines, polyamine cyanuric chloride condensates, aminated glycerol dichlorohydrins, and mixture thereof.

Another class of dye fixing agents suitable for use herein are cellulose reactive dye fixing agents. The cellulose reactive dye fixatives may be suitably combined with one or more dye fixatives described herein above in order to comprise a "dye fixative system". The term "cellulose reactive dye fixing agent" is defined herein as a dye fixing agent that reacts with the cellulose fibres upon application of heat or upon a heat treatment either in situ or by the formulator. Cellulose reactive dye fixatives are described in more detail in WO-A-00/15745.

Fabric Abrasion Reducing Polymers

The compositions herein can comprise fabric abrasion reducing polymers as benefit agent. Any suitable fabric abrasion reducing polymers may be used herein. Some examples of suitable polymers are described in WO-A-00/15745.

Wrinkle Reducing Agents

The compositions herein can comprise wrinkle reducing agents as benefit agent. Any suitable wrinkle reducing agents may be used herein. Some examples of suitable agents are described in WO-A-99/55953.

Optional Ingredients

There are a variety of optional ingredients that may be used in the compositions herein. Any suitable ingredient or mixture of ingredients may be used. Non-limiting examples of these optional ingredients are given below Disintegration Aid It is highly preferred that the compositions of the present invention comprise a disintegration aid. As used herein, the term "disintegration aid" means a substance or mixture of substances that has the effect of hastening the dispersion of the matrix of the present compositions on contact with water. This can take the form of a substances which hastens the disintegration itself or substances which allow the composition to be formulated or processed in such a way that the disintegrative effect of the water itself is hastened. For example, suitable disintegration aid include clays that swell on contact with water (hence breaking up the matrix of the compositions) and coatings which increase tablet integrity allowing lower compression forces to be used during manufacture (hence the tablets are less dense and more easily dispersed.

Any suitable disintegration aid can be used but preferably they are selected from disintegrants, coatings, effervescents, binders, clays, highly soluble compounds, cohesive compounds, and mixtures thereof.

Disintegrant

The shaped compositions herein can comprise a disintegrant that will swell on contact with water. Possible disintegrants for use herein include those described in the Handbook of Pharmaceutical Excipients (1986). Examples of suitable disintegrants include clays such as bentonite clay; starch: natural, modified or pregelatinised starch, sodium starch gluconate; gum: agar gum, guar gum, locust bean gum, karaya gum, pectin gum, tragacanth gum; croscarmylose sodium, crospovidone, cellulose, carboxymethyl cellulose, algenic acid and its salts including sodium alginate, silicone dioxide, polyvinylpyrrolidone, soy polysaccharides, ion exchange resins, and mixtures thereof.

Coating

Preferably the shaped compositions of the present invention are coated. The coating can improve the mechanical characteristics of a shaped composition while maintaining or improving dissolution. This very advantageously applies to multi-layer tablets, whereby the mechanical constraints of processing the multiple phases can be mitigated though the use of the coating, thus improving mechanical integrity of the tablet. The preferred coatings and methods for use herein are described in EP-A-846,754, herein incorporated by reference.

As specified in EP-A-846,754, preferred coating ingredients are for example dicarboxylic acids. Particularly suitable dicarboxylic acids are selected from oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof. Most preferred is adipic acid.

Preferably the coating comprises a disintegrant, as described hereinabove, that will swell on contact with water and break the coating into small pieces.

In a preferred embodiment, the coating comprises an acid having a melting temperature of at least 145° C., such as adipic acid for example, as well as a clay, such as a bentonite clay for example, whereby the clay is used as a disintegrant and also to render the structure of adipic acid more favourable for water penetration, thus improving the dispersion of the adipic acid in a aqueous medium. Preferred are clays having a particle size of less than 75 μm, more preferably of less than 53 μm, in order to obtain the desired effect on the structure of the acid. Preferred are bentonite clays. Indeed the acid has a melting point such that traditional cellulosic disintegrants undergo a thermal degradation during the coating process, whereas such clays are found to be more heat stable. Further, traditional cellulosic disintegrant such as Nymcel™ for example are found to turn brown at these temperatures.

A preferred optional materials for use in the coating herein is cation exchange resins, typically as described in *Kirk-Othmer's Encyclopedia of Chemical Technology,* $4^{th}$ Edition, Volume 14, pp 738–740. Commercially available cation exchange resins suitable for use herein include Amberlite® IR-120(plus), Amberlite® IR-120(plus) sodium form and Amberlite® IRP-69 (Rohm & Haas), Dowex® 50WX8-100, Dowex® HCR-W2 (Dow Chemicals), Amberlite® IRP-64 (Rohm & Haas), Dowex® CCR-3(plus) (Dow Chemical). The preferred cation-exchange resins for use herein are those sold by Purolite under the names Purolite® C100NaMR, a sodium salt sulfonated poly (styene-divinylbenzene) co-polymer and Purolite® C100CaMR, a calcium salt sulfonated poly(styene-divinylbenzene) co-polymer.

Effervescent

The shaped compositions of the present invention preferably comprise an effervescent. As used herein, effervescency means the evolution of bubbles of gas from a liquid, as the result of a chemical reaction between a soluble acid source and an alkali metal carbonate, to produce carbon dioxide gas. The addition of this effervescent to the detergent improves the disintegration time of the compositions. The amount will preferably be from 0.1% to 20%, more preferably from 5% to 20% by weight of the tablet. Preferably the effervescent should be added as an agglomerate of the different particles or as a compact, and not as separate particles.

Further dispesion aid could be provided by using compounds such as sodium acetate, nitrilotriacetic acid and salts thereof or urea. A list of suitable dispersion aid may also be found in Pharmaceutical Dosage Forms: Tablets, Vol. 1, 2nd Edition, Edited by H. A. Lieberman et al, ISBN 0-8247-8044-2.

Binders

Non-gelling binding can be integrated to the particles forming the tablet in order to facilitate dispersion. If non-gelling binder are used they are preferably selected from synthetic organic polymers such as polyethylene glycols, polyvinylpyrrolidones, polyacetates, water-soluble acrylate copolymers, and mixtures thereof. The handbook of Pharmaceutical Excipients 2nd Edition has the following binder classification: Acacia, Alginic Acid, Carbomer, Carboxymethylcellulose sodium, Dextrin, Ethylcellulose, Gelatin, Guar Gum, Hydrogenated vegetable oil type I, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Most preferred binder also have an active cleaning function in the wash such as cationic polymers. Examples include ethoxylated hexamethylene diamine quaternary compounds, bishexamethylene triamines or other such as pentaamines, ethoxylated polyethylene amines, maleic acrylic polymers.

Non-gelling binder materials are preferably sprayed on and hence preferably have a melting point of below 90° C., preferably below 70° C., more preferably below 50° C. so as not the damage or degrade the other active materials in the matrix. Most preferred are non-aqueous liquid binders (i.e.

not in aqueous solution) which may be sprayed in molten form. However, they may also be solid binders incorporated into the matrix by dry addition but which have binding properties within the tablet.

Non-gelling binder materials are preferably used in an amount of from 0.1% to 15%, by weight of total composition.

Clays

The compositions herein may also comprise clays. Preferred clays are expandable clays. As used herein the term "expandable" means clays with the ability to swell (or expand) on contact with water. These are generally three-layer clays such as aluminosilicates and magnesium silicates having an ion exchange capacity of at least 50 meq/100 g of clay. The three-layer expandable clays used herein are classified geologically as smectites.

There are two distinct classes of smectite-type clays. In the first, aluminium oxide is present in the silicate crystal lattice (general formula—$Al_2(Si_2O_5)_2(OH)_2$) and, in the second, magnesium oxide is present in the silicate crystal lattice (general formula—$Mg_3(Si_2O_5)_2(OH)_2$). It is recognised that the range of water hydration in the above formulae can vary with the processing to which the clay has been subjected. This is immaterial to the use of the smectite clays in the present invention in that the expandable characteristics of the hydrated clays are dictated by the silicate lattice structure. Furthermore, atom substitution by iron and magnesium can occur within the crystal lattice of the smectites, while the metal cations such as $Na^+$, $Ca^{2+}$, as well as $H^+$, can be co-present in the water of hydration to provide electrical neutrality. Except as noted hereinafter, such cation substitutions are immaterial to the use of the clays herein since the desirable physical properties of the clays are not substantially altered thereby. The three-layer alumino-silicates generally have a dioctahedral crystal lattice while the three-layer magnesium silicates generally have a trioctahedral crystal lattice.

The clays useful in the present invention preferably have an ion-exchange capacity of at least 50 meq/100 g of clay. More preferably at least 60 meq/100 g of clay. The smectite clays used herein are all commercially available. For example, clay useful herein include montmorillonite, volchonskoite, nontronite, hectorite, saponite, sauconitem, vermiculite and mixtures thereof. The clays herein are available under various tradenames, for example, Thixogel #1 and Gelwhite GP from Georgia Kaolin Co., Elizabeth, N.J., USA; Volclay BC and Volclay #325 from American Colloid Co., Skokie, Ill., USA; Black Hills Bentonite BH450 from International Minerals and Chemicals; and Veegum Pro and Veegum F, from R.T. Vanderbilt. It is to be recognised that such smectite-type minerals obtained under the foregoing tradenames can comprise mixtures of the various discrete mineral entities. Such mixtures of the smectite minerals are suitable for use herein.

The clay is preferably mainly in the form of granules, with at least 50%, preferably at least 75%, more preferably at least 90%, being in the form of granules having a size of at least 100 $\mu$m. Preferably the granules have a size of from 100 $\mu$m to 1800 $\mu$m and more preferably from 150 $\mu$m to 1180 $\mu$m.

Highly Soluble Compounds

The compositions of the present invention may comprise a highly soluble compound. Such a compound could be formed from a mixture or from a single compound.

A highly soluble compound is defined as follow:

A solution is prepared as follows comprising de-ionised water as well as 20 grams per liter of a specific compound:

1—20 g of the specific compound is placed in a Sotax Beaker. This beaker is placed in a constant temperature bath set at 10° C. A stirrer with a marine propeller is placed in the beaker so that the bottom of the stirrer is at 5 mm above the bottom of the Sotax beaker.

The mixer is set at a rotation speed of 200 turns per minute.

2—980 g of the de-ionised water is introduced into the Sotax beaker.

3—10 s after the water introduction, the conductivity of the solution is measured, using a conductivity meter.

4—Step 3 is repeated after 20, 30, 40, 50, 1 min, 2 min, 5 min and 10 min after step 2.

5—The measurement taken at 10 min is used as the plateau value or maximum value.

The specific compound is highly soluble according to the invention when the conductivity of the solution reaches 80% of its maximum value in less than 10 seconds, starting from the complete addition of the de-ionised water to the compound. Indeed, when monitoring the conductivity in such a manner, the conductivity reaches a plateau after a certain period of time, this plateau being considered as the maximum value. Such a compound is preferably in the form of a flowable material constituted of solid particles at temperatures comprised between 10 and 80° Celsius for ease of handling, but other forms may be used such as a paste or a liquid.

Examples of preferred highly soluble compounds include salts of acetate, urea, citrate, phosphate, sodium diisobutylbenzene sulphonate (DIBS), sodium toluene sulphonate, and mixtures thereof.

Cohesive Compounds

The compositions herein may comprise a compound having a Cohesive Effect on the detergent matrix forming the composition. Cohesive compounds are particularly useful in tablet compositions. The Cohesive Effect on the particulate material of a detergent matrix forming the tablet or a layer of the tablet is characterised by the force required to break a tablet or layer based on the examined detergent matrix pressed under controlled compression conditions. For a given compression force, a high tablet or layer strength indicates that the granules stuck highly together when they were compressed, so that a strong cohesive effect is taking place. Means to assess tablet or layer strength (also refer to diametrical fracture stress) are given in Pharmaceutical dosage forms:tablets volume 1 Ed. H. A. Lieberman et al, published in 1989.

The cohesive effect is measured by comparing the tablet or layer strength of the original base powder without compound having a cohesive effect with the tablet or layer strength of a powder mix which comprises 97 parts of the original base powder and 3 parts of the compound having a cohesive effect. The compound having a cohesive effect is preferably added to the matrix in a form in which it is substantially free of water (water content below 10% (pref. below 5%)). The temperature of the addition is between 10 and 80° C., more pref. between 10 and 40° C.

A compound is defined as having a cohesive effect on the particulate material according to the invention when at a given compacting force of 3000N, tablets with a weight of 50 g of detergent particulate material and a diameter of 55 mm have their tablet tensile strength increased by over 30% (preferably 60 and more preferably 100%) by means of the presence of 3% of the compound having a cohesive effect in the base particulate material.

An example of a compound having a cohesive effect is sodium diisoalkylbenzene sulphonate.

Enzymes

Another preferred ingredient useful in the compositions herein is one or more enzymes.

Suitable enzymes include enzymes selected from peroxidases, proteases, gluco-amylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, or mixtures thereof. Detergent compositions generally comprise a cocktail of conventional applicable enzymes like protease, amylase, cellulase, lipase.

Enzymes are generally incorporated in detergent compositions at a level of from 0.0001% to 2%, preferably from 0.001% to 0.2%, more preferably from 0.005% to 0.1% pure enzyme by weight of the composition.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Nowadays, it is common practice to modify wild-type enzymes via protein/genetic engineering techniques in order to optimize their performance efficiency in the detergent compositions of the invention. For example, the variants may be designed such that the compatibility of the enzyme to commonly encountered ingredients of such compositions is increased. Alternatively, the variant may be designed such that the optimal pH, bleach or chelant stability, catalytic activity and the like, of the enzyme variant is tailored to suit the particular cleaning application. In regard of enzyme stability in liquid detergents, attention should be focused on amino acids sensitive to oxidation in the case of bleach stability and on surface charges for the surfactant compatibility. The isoelectric point of such enzymes may be modified by the substitution of some charged amino acids. The stability of the enzymes may be further enhanced by the creation of e.g. additional salt bridges and enforcing metal binding sites to increase chelant stability. Furthermore, enzymes might be chemically or enzymatically modified, e.g. PEG-ylation, cross-linking and/or can be immobilized, i.e. enzymes attached to a carrier can be applied.

The enzyme to be incorporated in a detergent composition can be in any suitable form, e.g. liquid, encapsulate, prill, granulate . . . or any other form according to the current state of the art.

Bleaching System

Another ingredient which may be present is a perhydrate bleach, such as salts of percarbonates, particularly the sodium salts, and/ or organic peroxyacid bleach precursor, and/or transition metal bleach catalysts, especially those comprising Mn or Fe. It has been found that when the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and reduce the dissolution of the materials and also result in reduced performance.

Inorganic perhydrate salts are a preferred source of peroxide. Examples of inorganic perhydrate salts include percarbonate, perphosphate, persulfate and persilicate salts. The inorganic perhydrate salts are normally the alkali metal salts. Alkali metal percarbonates, particularly sodium percarbonate are preferred perhydrates herein.

The composition herein preferably comprises a peroxy acid or a precursor therefor (bleach activator), preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in-situ reaction of the precursor with a source of hydrogen peroxide. The hydrophobic peroxy acid bleach precursor preferably comprises a compound having a oxy-benzene sulphonate group, preferably NOBS, DOBS, LOBS and/or NACA-OBS, as described herein. The hydrophilic peroxy acid bleach precursor preferably comprises TAED.

Amide substituted alkyl peroxyacid precursor compounds can be used herein. Suitable amide substituted bleach activator compounds are described in EP-A-0170386.

The composition may contain a pre-formed organic peroxyacid. A preferred class of organic peroxyacid compounds are described in EP-A-170,386. Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Polymeric Dye Transfer Inhibiting Agents

The compositions of the present invention can comprise polymeric dye transfer inhibiting agents. If present, the shaped compositions herein preferably comprise from 0.01% to 10%, preferably from 0.05% to 0.5% by weight of total composition of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Builders

The compositions of the present invention can comprise builders. Suitable water-soluble builder compounds for use herein include water soluble monomeric polycarboxylates or their acid forms, homo- or co-polymeric polycarboxylic acids or their salts in which the polycarboxylic acid comprises at least two carboxylic radicals separated from each other by not more than two carbon atoms, carbonates, bicarbonates, borates, phosphates, and mixtures thereof.

The carboxylate or polycarboxylate builder can be monomeric or oligomeric in type although monomeric polycarboxylates are generally preferred. Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in GB-A-1,379,241, lactoxysuccinates described in GB-A-1,389,732, amino-succinates described in NL-A-7205873, the oxypolycarboxylate materials described in GB-A-1,387,447. Polycarboxylates containing four carboxy groups suitable for use herein include those disclosed in GB-A-1,261,829. Polycarboxylates containing sulfo substituents include the sulfosuccinates derivatives disclosed in GB-A-1,398,421, GB-A-1,398,422 and U.S. Pat. No. 3,936,448 and the sulfonated pyrolysed citrates described in GB-A-1,439,000. Alicyclic and heterocyclic polycarboxylates include cyclopentane-cis,cis, cis-tetracarboxylates, 2,5-tetrahydrofuran-cis-dicarboxylates, 2,2,5,5-tetra-hydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and phthalic acid derivatives disclosed in GB-A-1,425,343. Preferred polycarboxylates are hydroxycarboxylates containing up to three carboxy groups per molecule, more particularly citrates. The parent acids of monomeric or oligomeric polycarboxylate chelating agents or mixtures thereof with their salts e.g. citric acid or citrate/citric acid mixtures are also contemplated as useful builders. Examples of carbonate builders are the alkaline earth and alkali metal carbonates, including sodium carbonate and sesquicarbonate and mixtures thereof with ultra-fine calcium carbonate as disclosed in DE-A-2,321,001.

Suitable partially water-soluble builder compounds for use herein include crystalline layered silicates as disclosed in EP-A-164,514 and EP-A-293,640. Preferred crystalline layered sodium silicates of general formula:

$$NaMSi_xO_{2+1}.yH_2O$$

wherein M is sodium or hydrogen, x is a number from 1.9 to 4 and y is a number from 0 to 20. Crystalline layered sodium silicates of this type preferably have a two dimensional sheet structure, such as the so called δ-layered structure as described in EP-A-164,514 and EP-A-293,640. Methods of preparation of crystalline layered silicates of this type are disclosed in DE-A-3,417,649 and DE-A-3,742,043. A more preferred crystalline layered sodium silicate compound has the formula $\delta$-$Na_2Si_2O_5$, known as NaSKS-6™ available from Hoeschst AG.

Suitable largely water-insoluble builder compounds for use herein include the sodium aluminosilicates. Suitable aluminosilicates include the aluminosilicate zeolites having the unit cell formula $Na_z[(AlO_2)_z(SiO_2)_y].xH2O$ wherein z and y are at least 6, the molar ratio of z to y is from 1 to 0.5 and x is at least 5, preferably from 7.5 to 276, more preferably from 10 to 264. The aluminosilicate material are in hydrated form and are preferably crystalline, containing from 10% to 28%, more preferably from 10% to 22% water in bound form. The aluminosilicate zeolites can be naturally occurring materials but are preferably synthetically derived. Synthetic crystalline aluminosilicate ion exchange materials are available under the designations Zeolite A, Zeolite B, Zeolite P, Zeolite X, and Zeolite HS. Preferred aluminosilicate zeolites are colloidal aluminosilicate zeolites. When employed as a component of a detergent composition colloidal aluminosilicate zeolites, especially colloidal zeolite A, provide ehanced builder performance, especially in terms of improved stain removal, reduced fabric encrustation and improved fabric whiteness maintenance. Mixtures of colloidal zeolite A and colloidal zeolite Y are also suitable herein providing excellent calcium ion and magnesium ion sequestration performance.

Clay Softening System

The compositions of the present invention can comprise a clay softening system. Any suitable clay softening system may be used but preferred are those comprising a clay mineral compound and optionally a clay flocculating agent. If present, shaped compositions herein preferably contain from 0.001% to 10% by weight of total composition of clay softening system.

The clay mineral compound is preferably a smectite clay compound. Smectite clays are disclosed in the U.S. Pat. Nos. 3,862,058, 3,948,790, 3,954,632 and 4,062,647. Also, EP-A-299,575 and EP-A-313,146 in the name of the Procter & Gamble Company describe suitable organic polymeric clay flocculating agents.

Additional ingredients that may be added to the compositions herein include optical brighteners, organic polymeric compounds, alkali metal silicates, colourants, and lime soap dispersants.

Process

The present invention includes processes for making the aforementioned shaped compositions. When the compositions of the present invention are tablets they can be prepared simply by mixing the solid ingredients together and compressing the mixture in a conventional tablet press as used, for example, in the pharmaceutical industry. The tablets are preferably compressed at a force of not more than 10000 N/cm$^2$, more preferably not more than 3000 N/cm$^2$, even more preferably not more than 750 N/cm$^2$ Suitable equipment includes a standard single stroke or a rotary press (such as is available form Courtoy®, Korsch®, Manesty® or Bonals®). Preferably the tablets are prepared by compression in a tablet press capable of preparing a tablet comprising a mould. Multi-phase tablets can be made using known techniques.

A preferred tabletting process comprises the steps of:

i) Lowering the core punch and feeding the core phase of the tablet into the resulting cavity, ii) Lowering the whole punch and feeding the annular phase into the resulting cavity, iii) Raising the core punch up to the annular punch level (this step can happen either during the annular phase feeding or during the compression step).

iv) Compressing both punches against the compression plate. A pre-compression step can be added to the compression phase. At the end of the process, both punches are at the same level.

v) The tablet is then ejected out of the die cavity by raising the punch system to the turret head level.

The particulate material used for making the tablet of this invention can be made by any particulation or granulation process. An example of such a process is spray drying (in a co-current or counter current spray drying tower) which typically gives low bulk densities of 600 g/l or lower. Particulate materials of higher bulk density can be prepared by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallisation sentering, etc.

The shaped compositions herein preferably have a diameter of between 20 mm and 60 mm, preferably of at least 35 mm and up to 55 mm, and a weight of between 25 and 100 grams. The ratio of height to diameter (or width) of the tablets is preferably greater than 1:3, more preferably greater than 1:2. In a preferred embodiment according to the invention, the tablet has a density of at least 0.5 g/cc, more preferably at least 1.0 g/cc, and preferably less then 2.0 g/cc, more preferably less than 1.5 g/cc.

Method of Use

The present invention includes methods of washing in a washing machine comprising charging a washing machine with a shaped composition according to the present invention and washing in a conventional manner. Methods herein typically comprise treating soiled laundry with an aqueous wash solution in a washing machine having dissolved or dispensed therein an effective amount of a machine laundry detergent tablet composition in accord with the invention. By an effective amount of the detergent tablet composition it is meant from 15 g to 300 g of product dissolved or dispersed in a wash solution of volume from 5 to 65 liters, as are typical product dosages and wash solution volumes commonly employed in conventional machine laundry methods.

Preferably the shaped composition is dosed via the dispensing drawer of the machine but it can be added directly into the wash load. If added directly into the wash load, the shaped composition can be added on its own or in combination with a dispensing device such as a reticulated bag. A dispensing device is not strictly necessary for the shaped compositions of the present invention but consumers have become accustomed to using one due to the poor dissolution profiles of many of the prior art shaped compositions. The dispensing device is charged with the detergent product, and is used to introduce the product directly into the drum of the washing machine before the commencement of the wash cycle. Its volume capacity should be such as to be able to contain sufficient detergent product as would normally be used in the washing method. Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water. To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localized high concentrations of product in the drum of the washing machine at this stage of the wash cycle.

Preferred dispensing devices are reusable and are designed in such a way that container integrity is maintained in both the dry state and during the wash cycle.

Alternatively, the dispensing device may be a flexible container, such as a bag or pouch. The bag may be of fibrous construction coated with a water impermeable protective material so as to retain the contents, such as is disclosed in European EP-A-018678. Alternatively it may be formed of a water-insoluble synthetic polymeric material provided with an edge seal or closure designed to rupture in aqueous media as disclosed in EP-A-011500, EP-A-011501, EP-A-011502, and EP-A-011968. A convenient form of water frangible closure comprises a water soluble adhesive disposed along and sealing one edge of a pouch formed of a water impermeable polymeric film such as polyethylene or polypropylene.

pH of the Compositions

The shaped compositions of the present invention are preferably not formulated to have an unduly high pH. Preferably, the compositions of the present invention have a pH, measured as a 1% solution in distilled water, of from 7.0 to 12.5, more preferably from 7.5 to 11.8, most preferably from 8.0 to 11.5.

EXAMPLES

Example 1

First Phase:

| | % by weight, of total composition |
|---|---|
| Anionic agglomerates 1 | 7.1 |
| Anionic agglomerates 2 | 17.5 |
| Nonionic agglomerates | 9.1 |
| Cationic agglomerates | 4.6 |
| Layered silicate | 9.7 |
| Sodium percarbonate | 12.2 |
| Bleach activator agglomerates | 6.1 |
| Sodium carbonate | 7.27 |
| EDDS/Sulphate particle | 0.5 |
| Tetrasodium salt of Hydroxyethane Diphosphonic acid | 0.6 |
| Soil release polymer | 0.3 |
| Fluorescer | 0.2 |
| Zinc Phthalocyanine sulphonate encapsulate | 0.03 |
| Soap powder | 1.2 |
| Suds suppresser | 2.8 |
| Citric acid | 4.5 |
| Protease | 1 |
| Lipase | 0.35 |
| Cellulase | 0.2 |
| Amylase | 1.1 |
| Binder spray on system | 3.05 |
| Perfume spray on | 0.1 |
| DIBS (Sodium diisobutylbenzene sulphonate) | 2.1 |

Anionic agglomerates 1 comprise 40% anionic surfactant, 27% zeolite and 33% carbonate Anionic agglomerates 2 comprise 40% anionic surfactant, 28% zeolite and 32% carbonate Nonionic agglomerate comprise 26% nonionic surfactant, 6% Lutensit K-HD 96 ex BASF, 40% sodium acetate anhydrous, 20% carbonate and 8% zeolite.

Cationic agglomerate comprise 20% cationic surfactant, 56% zeolite and 24% sulfate Layered silicate comprises of 95% SKS 6 and 5% silicate Bleach activator agglomerates comprise 81% Tetraacetylethylene diamine (TAED), 17% acrylic/maleic copolymer (acid form) and 2% water EDDS/Sulphate particle particle comprise 58% of Ethylene diamineN,N-disuccinic acid sodium salt, 23% of sulphate and 19% water.

Zinc phthalocyanine sulphonate encapsulates are 10% active

Suds suppresser comprises 11.5% silicone oil (ex Dow Corning), 59% zeolite and 29.5% $H_2O$ Binder spray on system comprises 0.5 parts of Lutensit K-HD 96 and 2.5 parts of Polyethylene glycols (PEG)

Second Phase

| | % by weight, of total composition |
|---|---|
| Softerner and perfume bead | 8.4 |

Perfume beads composition contains 56% expancel 091DE80, 7% silica, 8% perfume, 5% crosslinked polyvinylalcohol (PVA)-borate, 5% water, 18% cationic softener N,N-di(candyl-oxy-ethyl)-N-methyl,N-(2-hydroxyethyl) ammonium methyl sulfate and 1% of laundry compatible Zeneca Monastral blue Manufacturing:

Manufacturing of the First Phase:

The detergent active composition of the first phase was prepared by admixing the granular components in a mixing drum for 5 minutes to create an homogenous particle mixture. During this mixing, the spray-ons were carried out with a nozzle and hot air using the binder composition described above.

Manufacturing of Phase 2:

The beads of the second phase were manufactured using a Braun food processor with a standard stirrer where the dry mixture described above is added. The mixer was operated at high speed during 1 minute and the mix is poured into a Fuji Paudal Dome Gran DGL1 (Japan) extruder with 3 mm diameter holes in the extruder tip plate and operated at 70 revolutions per minute. The resulting product was added into a Fuji Paudal Marumerizer QJ-230 were it is operated at 1000 revolutions per minute for 5 minutes were a good spheronization was achieved.

In a further step, the beads were coated by a partially insoluble coating described. This was achieved by spraying the beads in a conventional mix drum with 4% (weight beads based) of a mixture of 80% cross linked polyvinyl alcohol-borate and 20% water at 70° C. using a spray nozzle and hot air. The beads are then left in a rotating drum for 60 minutes and hot air was injected in order to evaporate part of the water contained in the PVA coating. The final water content in the bead is mentioned in the bead composition above.

The resulting beads had a density of 950 kg/m$^3$ which floated in de-ionized water at 20° C. The particle size was measured using the ASTM D502-89 method and the calculated average particle size was 2.6 mm.

Tablet Manufacturing:

The multi-phase tablet composition was prepared using an Instron 4400 testing machine and a standard die for manual tablet manufacturing. 35 g of the detergent active composition of the first phase was fed into the dye of 41×41 mm with rounded edges that has a ratio of 2.5 mm. The mix was compressed with a force of 1,500 N with a punch that has a suitable shape to form a concave mould of 25 mm diameter and 10 mm depth in the tablet. The shaped punch was carefully removed leaving the tablet into the dye. 4 g of beads that will form the second phase were introduced into the mould left in the first tablet shape and a final compression of 1,700 N was applied to manufacture the multiphase tablet using a flat normal punch. The tablet is then manually ejected from the dye.

In a following step, the tablet made with the process described above were coated by manually dipping them into a molten mixture of coating at 170° C. and let them cool back to room temperature allowing the coating to harden. The composition and percentage of the coating are described in the tablet composition above.

Several tablets are made in order to perform the tests indicated below.

Testing:

Assessing the Disintegration Profile for the Tablet:

In order to test the disintegration time of the tablets, a Sotax AE7 apparatus was used. The tablets were introduced in the glass vessel filled with 1 liter de-ionized water at 2020 C. The paddle stirring element was activated at a speed of 100 rotations per minute during 1 minute.

The solution and all the undissolved particles are poured through a 4×4 mm sieve and no pieces of tablets and particles were retained.

Using the Tablets in a Washing Machine:

The coated multiphase tablets produced with the method and composition described above were tested in a western European washing machine Bauknecht WA9850 using a standard 40° C. wash cycle without pre-wash and comprising a main wash cycle and three rinse cycles.

After introducing 1.2 kg of mixed soiled fabrics in the drum of the washing machine, two tablets are introduced in the main wash dispenser and the washing machine is activated. The two tablets were disintegrated in less than one minute and all the tablet composition was driven inside the drum through the piping of the washing machine. In order to monitor the dissolution of the beads through out the wash, the undissolved particles were collected from the drum and from the clothes at different timings. The test was restarted after each evaluation. One side by side comparisons was done by testing floating beads vs. non floating beads (where the Expancel was replaced by sodium carbonate). The results of the test can be observed in the table below:

Percentage of each Phase Remaining Undissolved in the Drum at Different Periods of the Wash and Rinse Cycle

| Washing machine cycle | Floating + rinse release | | Non-floating | |
|---|---|---|---|---|
| Phase: | First | Second | First | Second |
| 2' after start of the wash cycle | 80% | 96% | 81% | 94% |
| End of wash cycle (before the wash liquor gets pumped out) | 5% | 81% | 4% | 81% |
| Beginning of 1st rinse cycle (after water intake) | 2% | 69% | 2% | 21% |
| End of 1st rinse cycle (before the rinse liquor is pumped out) | 1% | 55% | 1% | 15% |
| Beginning of last rinse cycle | — | 10% | — | 4% |
| End of the last rinse cycle (after all the water has been pumped out and after last spin) | — | 6% | — | 2% |

A side by side comparison was achieved with an expert panel to evaluate the performance of the tablets on cotton terry cloth towels. Two trained and qualified judges evaluated dry perfume release and softness performance using a −4 to +4 nine point scale. Each group of tablets was evaluated by a paired comparison with the control tablets (Ariel essential tablets) and the preferred items were given a numerical score, with a −4 corresponding to a strong preference for the precedent item over the current one and a +4 corresponding to a strong preference for the current item over the precedent one, and 0 being no difference.

An average of the scores obtained in a Bauknecht WA9850 using 1.2 kg of Terry towels in a standard 40° C. wash cycle without pre-wash and comprising a main wash cycle and three rinse cycles is shown below:

| Tablet used | Softening performance vs control | Perfume release vs control |
|---|---|---|
| Control (Ariel Essential tablets) | 0 | 0 |
| Tablets with floating and delayed release beads | 3.4 | 2.2 |
| Tablets with non floating beads | 1.2 | 0.8 |

Example 2

First Phase:

| | % by weight, of total composition |
|---|---|
| Clay extrudate | 14 |
| Flocculant agglomerate | 3.8 |
| Anionic agglomerates 1 | 32 |
| Anionic agglomerates 2 | 2.27 |
| Sodium percarbonate | 8.0 |
| Bleach activator agglomerates | 2.31 |
| Sodium carbonate | 21.066 |
| EDDS/Sulphate particle | 0.19 |
| Tetrasodium salt of Hydroxyethane Diphosphonic acid | 0.34 |
| Fluorescer | 0.15 |
| Zinc phtalocyanine sulphonate encapsulate | 0.027 |
| Soap powder | 1.40 |
| Suds suppresser | 2.6 |
| Citric acid | 4.0 |
| Protease | 0.45 |
| Cellulase | 0.20 |
| Amylase | 0.20 |
| Binder spray-on | 2.0 |
| Perfume spray-on | 0.1 |

Clay extrudate comprise 97% of CSM Quest 5A clay and 3% water

Flocculant raw material is polyethylene oxide with an average molecular weight of 300,000

Anionic agglomerates 1 comprise of 40% anionic surfactant, 27% zeolite and 33% carbonate Anionic agglomerates 2 comprise of 40% anionic surfactant, 28% zeolite and 32% carbonate Perfume beads composition contains 46% expancel 091DE80, 8% silica, 10% silicate, 15% perfume, 5% crosslinked polyvinylalcohol-borate, 10% water and 7% sodium sulfate.

Nonionic agglomerate comprise 26% nonionic surfactant, 6% Lutensit K-HD 96 , 40% sodium acetate anhydrous, 20% carbonate and 8% zeolite.

Cationic agglomerate comprise of 20% cationic surfactant, 56% zeolite and 24% sulfate Layered silicate comprises of 95% SKS 6 and 5% silicate Bleach activator agglomerates comprise of 81% TAED, 17% acrylic/maleic copolymer (acid form) and 2% water Zinc phthalocyanine sulphonate encapsulates are 10% active Ethylene diamine N,N-disuccinic acid sodium salt/Sulphate particle comprise of 58% of Ethylene diamine N,N-disuccinic acid sodium salt, 23% of sulphate and 19% water.

Suds suppresser comprises of 11.5% silicone oil (ex Dow Corning), 59% zeolite and 29.5% water Binder spray on system comprises of 0.5 parts of Lutensit K-HD 96 and 2.5 parts of PEGs Second Phase:

| | % by weight, of total composition |
|---|---|
| Perfume bead composition | 4.9 |

Perfume beads composition contains 46% expancel 091DE80, 8% silica, 10% silicate, 15% perfume, 5% crosslinked polyvinylalcohol-borate, 10% water and 7% sodium sulfate.

Example 3

First Phase:

| | % by weight, of total composition |
|---|---|
| Clay extrudate | 13 |
| Flocculant agglomerate | 3.5 |
| Anionic particle | 38.2 |
| Sodium percarbonate | 8.0 |
| Bleach activator agglomerates | 2.3 |
| HPA sodium tripolyphosphate | 11.4 |
| Sodium carbonate | 10.043 |
| EDDS/Sulphate particle | 0.19 |
| Tetrasodium salt of Hydroxyethane Diphosphonic acid | 0.34 |
| Fluorescer | 0.15 |
| Zinc phtalocyanine sulphonate encapsulate | 0.027 |
| Soap powder | 1.40 |
| Suds suppresser | 2.6 |
| Citric acid | 1.0 |
| Protease | 0.45 |
| Cellulase | 0.20 |
| Amylase | 0.20 |
| Perfume | 1.0 |
| Binder spray-on | 2.0 |

Clay extrudate comprise 97% of CSM Quest 5A clay and 3% water

Flocculant raw material is polyethylene oxide with an average molecular weight of 300,000

Perfume beads composition contains 46% expancel 091DE80, 8% silica, 10% silicate, 15% perfume, 5% crosslinked polyvinylalcohol-borate, 10% water and 7% sodium sulfate.

Layered silicate comprises of 95% SKS 6 and 5% silicate

Bleach activator agglomerates comprise of 81% TAED, 17% acrylic/maleic copolymer (acid form) and 2% water Zinc phthalocyanine sulphonate encapsulates are 10% active Ethylene diamine N,N-disuccinic acid sodium salt/Sulphate particle comprise of 58% of Ethylene diamine N,N-disuccinic acid sodium salt, 23% of sulphate and 19% water.

Suds suppresser comprises of 11.5% silicone oil (ex Dow Corning), 59% zeolite and 29.5% water Binder spray on system comprises of 0.5 parts of Lutensit K-HD 96 and 2.5 parts of PEGs The anionic particle was a blown powder with: 17.7% sodium linear alkylbenzene sulphonate, 2% Nonionic C35 7EO, 5.9% Nonionic C35 3EO, 0.5% soap, 47.8% sodium tripolyphosphate (Rhodia-phos HPA 3.5 from Rhone Poulenc), 10.8 sodium silicate, 0.4% sodium carboxymethly cellulose, 2.1% Acrylate/maleate co-polymer and 12.9% of moisture and salts.

Second Phase:

| | % by weight, of total composition |
|---|---|
| Perfume bead composition | 4.9 |

Perfume beads composition contains 46% expancel 091DE80, 8% silica, 10% silicate, 15% perfume, 5% crosslinked polyvinylalcohol-borate, 10% water and 7% sodium sulfate.

What is claimed is:

1. A shaped detergent composition comprising:

(a) a surfactant; and (b) a plurality of discrete particles comprising benefit agent, said particles having a average particle size of at least 1.2 mm wherein the particles comprising the benefit agent float in deionised water at 20° C.

2. A detergent composition according to claim 1 wherein the particles comprising benefit agent have an average particle size of from 1.5 mm to 10 mm.

3. A detergent composition according to claim 1 wherein the particles comprising benefit agent have an average particle size of from 2.3 mm to 4 mm.

4. A detergent composition according to claim 1 wherein the benefit agent is selected from the group consisting of cationic softening agents, soil-release agents, perfumes, suds-suppressing system, anti-wrinkle agents, chelating agents, chloride scavengers, dye fixing agents, fabric abrasion reducing polymers, and mixture thereof.

5. A detergent composition according to claim 1 wherein the benefit agent is selected from the group consisting of cationic softening agents, perfumes, pro-perfumes and mixtures thereof.

6. A detergent composition according to claim 1 comprising at least two phases, the first phase, comprising surfactant, in the form of a shaped body with at least one mold therein and the second phase, comprising benefit agent, compressed within the mold.

7. A detergent composition according to claim 1 comprising from 0.5% to 75% by weight of surfactant.

8. A method of washing in a washing machine comprising charging a washing machine with a shaped detergent composition according to claim 1 and washing in a conventional manner.

9. A process for producing a detergent composition according to claim 1, said process comprising a mixing step and a compression step.

* * * * *